US009754457B2

(12) United States Patent
Meyer

(10) Patent No.: US 9,754,457 B2
(45) **Date of Patent: *Sep. 5, 2017**

(54) ELECTRONIC GAMING MACHINE AND GAMING METHOD

(71) Applicant: AINSWORTH GAME TECHNOLOGY LIMITED, Newington, NSW (AU)

(72) Inventor: Jason Meyer, Abbotsford (AU)

(73) Assignee: Ainsworth Game Technology Limited, Newington, NSW (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/793,314

(22) Filed: Mar. 11, 2013

(65) Prior Publication Data

US 2014/0038690 A1 Feb. 6, 2014

(30) Foreign Application Priority Data

Aug. 2, 2012 (AU) ..... 2012903340

(51) Int. Cl.

| | |
|---|---|
| ***G07F 17/34*** | (2006.01) |
| ***G07F 17/32*** | (2006.01) |
| *G07F 17/00* | (2006.01) |

(52) U.S. Cl.

CPC ..... *G07F 17/34* (2013.01); *G07F 17/3267* (2013.01); *G07F 17/00* (2013.01); *G07F 17/32* (2013.01); *G07F 17/3244* (2013.01)

(58) Field of Classification Search

CPC ..... G07F 17/00; G07F 17/32; G07F 17/3244

USPC ..... 463/16, 20, 42; 273/138.1, 138.2, 143 R

See application file for complete search history.

(56) References Cited

U.S. PATENT DOCUMENTS

| | | | | |
|---|---|---|---|---|
| 5,833,537 | A * | 11/1998 | Barrie | 463/21 |
| 6,120,031 | A | 9/2000 | Adams | |
| 7,666,085 | B2 * | 2/2010 | Vorias et al. | 463/20 |
| 7,695,365 | B2 * | 4/2010 | Casey | G07F 17/3265 463/20 |
| 8,012,013 | B2 | 9/2011 | Walker et al. | |
| 2003/0060276 | A1 * | 3/2003 | Walker et al. | 463/25 |
| 2004/0048646 | A1 * | 3/2004 | Visocnik | 463/16 |
| 2005/0070354 | A1 * | 3/2005 | Baerlocher et al. | 463/20 |
| 2006/0058095 | A1 * | 3/2006 | Berman et al. | 463/16 |
| 2006/0189380 | A1 * | 8/2006 | Schultz et al. | 463/20 |
| 2008/0108411 | A1 * | 5/2008 | Jensen et al. | 463/20 |
| 2008/0167113 | A1 | 7/2008 | Plowman | |
| 2009/0075722 | A1 * | 3/2009 | Louie et al. | 463/20 |
| 2010/0197377 | A1 * | 8/2010 | Aoki | G07F 17/3267 463/20 |
| 2011/0045892 | A1 * | 2/2011 | Vann | G07F 17/34 463/20 |

(Continued)

*Primary Examiner* — Jay Liddle
*Assistant Examiner* — Ryan Hsu
(74) *Attorney, Agent, or Firm* — Cook Alex Ltd.

(57) ABSTRACT

An electronic gaming machine has an electronic game controller and a display where game symbols are arranged in an array of predetermined groups, at least one of the groups displaying at least one special symbol in a first play of the game and a subsequent play. In the first play, the electronic game controller selects a first group to display the at least one special symbol and in the subsequent play, the electronic game controller selects a different group to the first group to display the at least one special symbol. A gaming method is also provided.

12 Claims, 9 Drawing Sheets

(56) References Cited

U.S. PATENT DOCUMENTS

2012/0258785 A1* 10/2012 Suda et al. ..... 463/20
2013/0017881 A1 1/2013 Watkins

* cited by examiner

RULES

| Flower Reel Table | | | | |
|---|---|---|---|---|
| Reel order for Guaranteed 'Flower' reels. | | | | |
| FREE GAME | 1 GUARANTEED REELS | 2 GUARANTEED REELS | 3 GUARANTEED REELS | 4 GUARANTEED REELS |
| 1 | 1 | 34 | 245 | 2345 |
| 2 | 2 | 23 | 235 | 1235 |
| 3 | 3 | 15 | 135 | 1245 |
| 4 | 4 | 24 | 245 | 1235 |
| 5 | 5 | 13 | 235 | 1345 |
| 6 | 1 | 23 | 135 | 2345 |
| 7 | 2 | 34 | 234 | 1235 |
| 8 | 3 | 12 | 123 | 1245 |
| 9 | 2 | 24 | 235 | 1235 |
| 10 | 3 | 34 | 245 | 2345 |

5 Credits Per Line
Press GAME RULES to view more rules

Sugar 'n SPICE Hummin' Bird

CREDIT 9,750 $97.50 | BET 250 $2.50 | WIN 7,100 $71.00 | RETURN TO GAME | 1 ¢ $1 = 100 CREDITS

*Fig. 9*

ELECTRONIC GAMING MACHINE AND GAMING METHOD

BACKGROUND

The present invention relates to an electronic gaming machine and in a particular an electronic gaming machine using a base game and a feature game. The invention has been developed primarily for use as an electronic gaming machine and will be described hereinafter by reference to this application.

The following discussion of the prior art is intended to present the invention in an appropriate technical context and allow its advantages to be properly appreciated. Unless clearly indicated to the contrary, however, reference to any prior art in this specification should not be construed as an express or implied admission that such art is widely known or forms part of common general knowledge in the field.

Conventional gaming machines typically involve awarding prizes to a player according to predetermined combinations of game symbols that appear on an array of game squares displayed on a screen, typically organised into three rows and five columns (a 5×3 array). Other arrays, such as a 3×3 or 4×3, may be used. Each gaming machine randomly selects the game symbols that appear on the array, each column of the array being a "reel".

In an electronic gaming machine, the mechanical reels are replaced with video images of the reels, which are displayed on a video display screen. The electronic gaming machine has an internal electronic game controller, typically a computer, that controls the display of images on the video display screen so that the reels are visibly spun on the screen to simulate a physical reel of a traditional gaming machine. Electronic gaming machines are also more versatile in presenting game information, varying the probabilities for a player to win a prize and varying the type of game that is played.

In an electronic gaming machine, the mechanical reels are replaced with video images of the reels, which are displayed on a video display screen. The electronic gaming machine has an internal electronic game controller, typically a computer, that controls the display of images on the video display screen so that the reels are visibly spun on the screen to simulate a physical reel of a traditional gaming machine. Electronic gaming machines are also more versatile in presenting game information, varying the probabilities for a player to win a prize and varying the type of game that is played.

Bonus or "feature" games may be provided by an electronic gaming machine in addition to the base or main game. Typically feature games use the same set of reels as the main game and are limited to a set of free games operated under a single set of rules. Once the free feature games have been played, the electronic gaming machine resets itself and returns the player back to the base game. This standard structure to game play limits the variation in the play of the electronic gaming machine. Consequently, it is difficult to retain player interest because there is no apparent incentive for the player to continue playing the same electronic gaming machine once the player becomes familiar with the feature game and the main game. Also, it is difficult to retain player interest since there is little differentiation between gaming machines in terms of the main and feature games that are played.

It is an object of the present invention to overcome or substantially ameliorate one or more of the disadvantages of prior art, or at least to provide a useful alternative.

It is an object of the invention in at least one preferred form to provide an electronic gaming machine and a method for controlling an electronic gaming machine that encourages player interest.

SUMMARY

According to a first aspect of the invention, there is provided an electronic gaming machine comprising:

a display for displaying game symbols for playing a game, where predetermined winning combinations of randomly selected game symbols award prizes to a player and said game symbols are arranged in an array of predetermined groups, and an electronic game controller for controlling the display of game symbols on the display, wherein said electronic gaming machine guarantees that at least one of said groups displays at least one special symbol in a first play of said game and a subsequent play of said game;

in said first play, said electronic game controller selects at least one first group to display said at least one special symbol, and in said subsequent play, said electronic game controller selects at least one second group different to said at least one first group to display said at least one special symbol.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Preferably, said electronic gaming machine guarantees the selection of two or more first groups to display said at least one special symbol, wherein in said first play, said electronic game controller selects two or more first groups to display said at least one special symbol with said at least one first group, and in said subsequent play, said electronic game controller reselects at least one of said first groups to display said at least one special symbol with said at least one second group.

Preferably, said electronic game controller selects said first groups, reselects said at least one of said first groups and selects said at least one second group according to a predetermined order for said first play and said subsequent play. Alternatively, said electronic game controller randomly selects said first groups for said first play, and randomly reselects said at least one of said first groups and randomly selects said at least one second group for said subsequent play.

Preferably, said electronic game controller selects said at least one first group and said at least one second group according to a predetermined order for said first play and said subsequent play. Alternatively, said electronic game controller randomly selects said at least one first group and said at least one second group for said first play and said subsequent play.

Preferably, said electronic game controller reselects at least one of the selected groups from a preceding play of said game and further selects a new group that was not selected in said preceding play for each successive play of said game after said subsequent play. Alternatively, said electronic game controller reselects at least one of the selected groups from a preceding play of said game and selects a new group that was not selected in said preceding play for a predetermined number of successive plays of said game after said subsequent play.

Preferably, said first and said subsequent plays of said game are consecutive. Alternatively, said first and said subsequent plays are within a predetermined set of plays of said game.

Preferably, said electronic game controller guarantees said display of said at least one special symbol in response to a trigger event. Alternatively, said electronic game controller selects said selected groups in response to a trigger event.

Preferably, said electronic game controller randomly generates a number and determines whether said randomly generated number is a predetermined number or within a predetermined range of numbers. Alternatively, said trigger event comprises said electronic game controller randomly generating a number and determining whether said randomly generated number is a predetermined number or within a predetermined range of numbers. More preferably, said predetermined number or range of numbers corresponds to the number of selected groups for said first play. Where two or more first groups are selected to display said at least one special symbol for said first play, alternatively, said predetermined number is more than two and is equivalent to the number of selected first groups for said first play.

Preferably, said trigger event comprises the appearance of at least one trigger symbol. Preferably, the electronic game controller randomly determines the appearance of said trigger symbol. In another preferred form, said trigger event further comprises a different random event determined by said electronic game controller during play of said game.

Preferably, said game is a feature game of said electronic gaming machine. Alternatively, said game is a main or base game of said electronic gaming machine.

Where said game is a feature game, said electronic game controller also causes said display to display game symbols for playing a base game, wherein predetermined winning combinations of randomly selected game symbols results in the award of prizes to said player. Preferably, in response to said trigger event, said electronic game controller causes said display to display game symbols for playing said feature game.

Preferably, said trigger event further comprises the appearance of at least one trigger symbol during play of said base game. In one preferred form, said trigger event comprises the appearance of three trigger symbols during play of said base game. Preferably, the electronic game controller randomly determines the appearance of said trigger symbol (s). Alternatively, said trigger event further comprises a different random event determined by said electronic game controller during play of said base game.

Preferably, said electronic game controller awards a random number of plays of said game in response to the trigger event. Alternatively, the number of plays of said game awarded by said electronic game controller in response to the trigger event depends of the amount wagered by the player.

Preferably, said electronic game controller causes the display of said feature game and said base game during play of said base game, said feature game being inactive until triggered. In this preferred form, the change in said feature game from being inactive to active may be indicated on the display. Alternatively, said electronic game controller causes the display of said feature game in response to said trigger event.

Preferably, said electronic game controller causes the display of said base game on a separate display to said display. Alternatively, said electronic game controller causes the display of said feature game and said base game on the same display.

According to a second aspect of the invention, there is provided a gaming method for an electronic gaming machine comprising a display and an electronic game controller, the method comprising the steps of:

controllably displaying game symbols for playing a game, where predetermined winning combinations of randomly selected game symbols in said game results in the award of prizes to a player and said game symbols are arranged in an array of predetermined groups;

guaranteeing at least one of said groups displays at least one special symbol in a first play of said game and a subsequent play of said game;

selecting at least one first group to display at least one special symbol in said first play, and in said subsequent play, selecting at least one second group different to said at least one first group to display said at least one special symbol.

Preferably, said guaranteeing step comprises guaranteeing the selection of two or more first groups to display said at least one special symbol, said method further comprising the steps of selecting in said first play two or more first groups to display said at least one special symbol, and reselecting in said subsequent play at least one of said first groups to display said at least one special symbol with said at least one second group.

Preferably, said selecting step of said first groups, said reselecting step of said at least one of said first groups and selecting step of said at least one second group are performed according to a predetermined order for said first play and said subsequent play. Alternatively, said selecting step of said first groups for said first play, and said reselecting step of said at least one of said first groups and selecting step of said at least one second group for said subsequent play are performed randomly.

Preferably, said selecting steps comprise selecting said at least one first group and said at least one second group according to a predetermined order for said first play and said subsequent play. Alternatively, said selecting steps comprise randomly selecting said at least one first group for said first play and said at least one second group for said subsequent play.

Preferably, said method further comprises the steps of reselecting at least one of said selected groups from a preceding play of said game and further selecting a new group that was not selected in said preceding play for each successive play of said game after said subsequent play. Alternatively, said method further comprises the steps of reselecting at least one of said selected groups from a preceding play of said game and further selecting a new group that was not selected in said preceding play for a predetermined number of successive plays of said game after said subsequent play.

Preferably, said guaranteeing step is performed in response to a trigger event. Alternatively, said selecting steps are performed in response to a trigger event.

Preferably, said method further comprises the step of randomly generating a number and determining whether said randomly generated number is a predetermined number or within a predetermined range of numbers. Alternatively, said trigger event comprises said electronic game controller randomly generating a number and determining whether said randomly generated number is a predetermined number or within a predetermined range of numbers. More preferably, said predetermined number or range of numbers corresponds to the number of said first groups selected for said first play.

Preferably, said method further comprises the step of consecutively performing said first play and said subsequent play. Alternatively, said method further comprises the step of performing said first play and said subsequent play within a predetermined set of plays of said game.

Preferably, said game is a feature game of said electronic gaming machine. Alternatively, said game is a main or base game of said electronic gaming machine. Where said game is a feature game, said method further comprises the step of causing said display to display game symbols for playing a base game, wherein predetermined winning combinations of randomly selected game symbols results in the award of prizes to said player.

Preferably, said method comprises the step of awarding a random number of plays of said game in response to the trigger event. Alternatively, the awarding step comprises awarding the number of plays of said game based on the amount wagered by the player.

Preferably, said displaying step comprises displaying said feature game and said base game during play of said base game, said feature game being inactive until triggered. In this preferred form, the change in said feature game from being inactive to active may be indicated on the display. Alternatively, said displaying step comprises displaying said feature game in response to said trigger event.

Preferably, said method further comprises displaying said base game on a separate display to said display. Alternatively, said method further comprises displaying said feature game and said base game on the same display.

In both aspects of the invention, it is preferred that each of said groups comprises one or more of said game symbols. More preferably each of said groups comprises one or more visible positions in said array, each visible position displaying one of said game symbols. In one preferred form, each of said groups comprises animated images to simulate the rotation of a mechanical reel. In another preferred form, each of said groups comprises a row or a column of visible positions on said array, each visible position displaying one of said game symbols. In one particularly preferred form, said group comprises a column of said array displaying at least three visible positions, said column being animated to simulate the rotation of a mechanical reel. In an alternative preferred form, at least two of said groups are arranged in a column of said array, with each of said groups comprising animated images to simulate the rotation of a mechanical reel.

Likewise in both aspects of the invention, preferably, said at least one special symbol comprises at least one of a replacement symbol, a wild card symbol, a scatter symbol, bonus prizes, collector symbols, a win multiplier, wild multipliers, bonus wilds, random wild symbols, progressive symbols, bonus credits and jackpot symbols.

Preferably, the same game symbols are used in said feature game and said base game. Alternatively, different game symbols or a mixture of the same and different game symbols are used in said feature game and said base game.

Preferably, said feature game has the same number of game symbols as said base game. Alternatively, said feature game and said base game have different numbers of game symbols.

Preferably, the game symbols in said feature game and said base game are organised or arranged in the same way. In another preferred form, the game symbols in said feature game and said base game are organised or arranged differently to each other.

Preferably, said game symbols in said base game are arranged in an array. More preferably, said game symbols in said feature game and said base game are arranged in arrays of the same shape or type. Alternatively, said game symbols in said feature game and said base game are arranged in differently shaped arrays. The shapes of said arrays are preferably rectangular, circular, triangular, oval, semi-circular or other non-rectangular shape.

The method also preferably has the preferred features of the first aspect of the invention not otherwise stated above, where applicable.

According to a third aspect of the invention, there is provided a computer system comprising a central processing unit configured for communication with an electronic gaming machine, wherein said computer system is configured to perform the method of the second aspect of the invention.

According to a fourth aspect of the invention, there is provided a computer program configured to perform the method of the second aspect of the invention.

According to a fifth aspect of the invention, there is provided a non-transitive carrier medium carrying computer executable code that, when executed on a central processing unit configured for communication with an electronic gaming machine, causes the central processing unit to perform the method of the second aspect of the invention.

BRIEF DESCRIPTION OF THE DRAWINGS

Preferred embodiments of the invention will now be described, by way of example only, with reference to the accompanying drawings in which:

FIG. 9 is a schematic drawing of a table for the game of FIGS. 3 to 8.

DETAILED DESCRIPTION OF THE VARIOUS EMBODIMENTS

Figure 1:
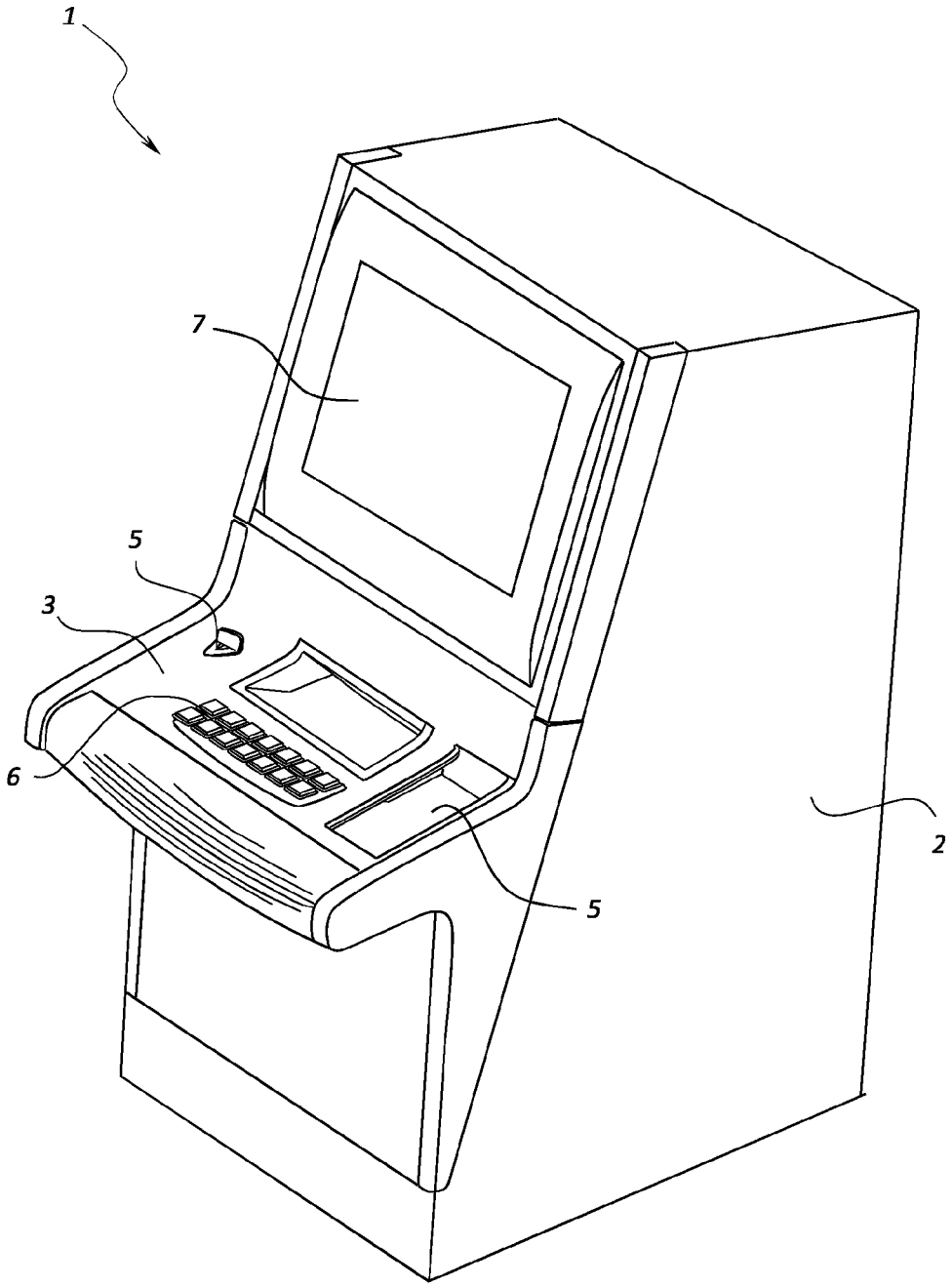
FIG. 1 is a perspective view of an electronic gaming machine according to an embodiment of the invention.
Figure 2:
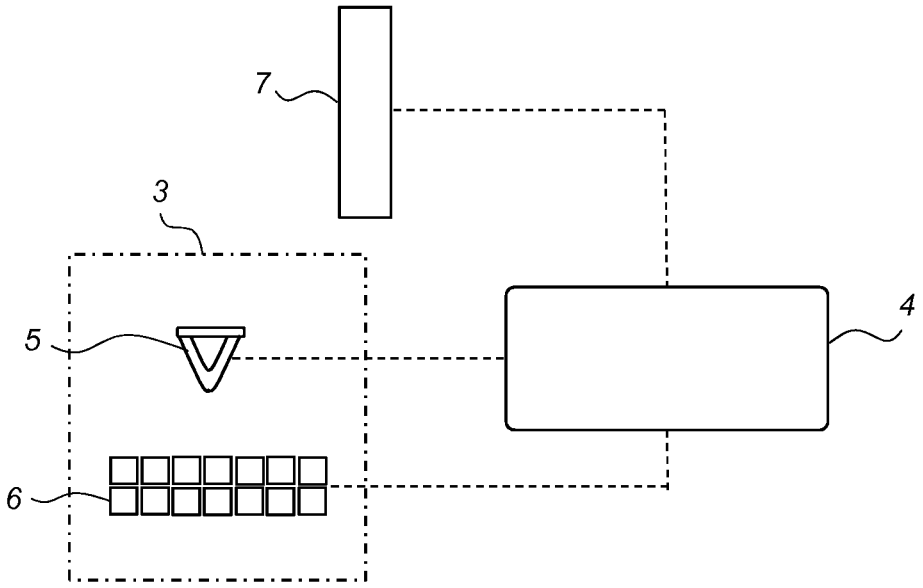
FIG. 2 is a schematic drawing of an electronic game controller for the electronic gaming machine of FIG. 1.

Referring to FIG. 1, an electronic gaming machine 1 according to a first embodiment of the invention includes a cabinet 2, a console 3 and an internal electronic game controller 4. The console 3 has various input devices including vending slots 5 for receiving monetary bets and a plurality of buttons 6 for actuation by a player. The electronic game controller 4 is generally in the form of a central processing unit, such as a computer, and is in electronic communication with a display 7 and various input devices on the console 3, as best shown in FIG. 2. It is also appreciated that a person skilled in the art would readily understand the location and use of the electronic game controller 4 in the electronic gaming machine 1.

Figure 3:
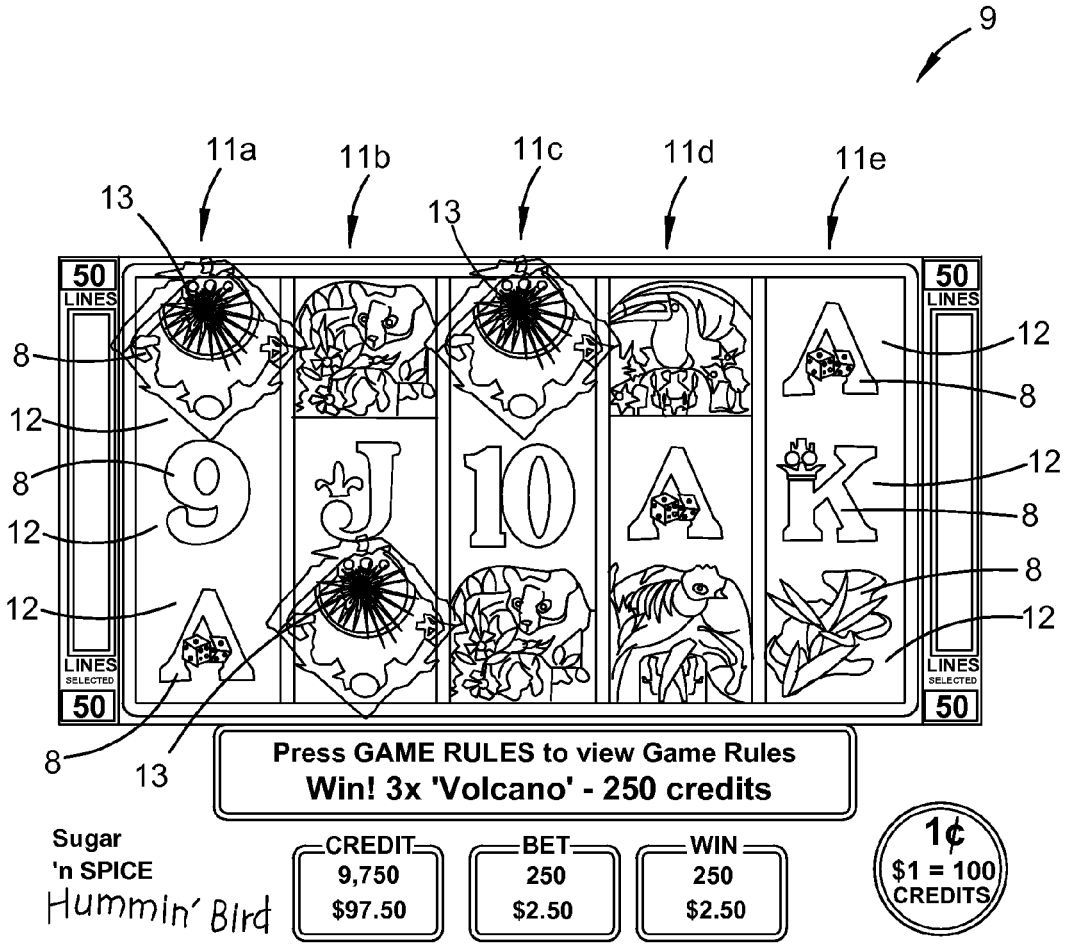
FIGS. 3 to 8 are schematic drawings of the display of FIG. 1 illustrating a game played on the electronic gaming machine of FIG. 1.
Figure 5:
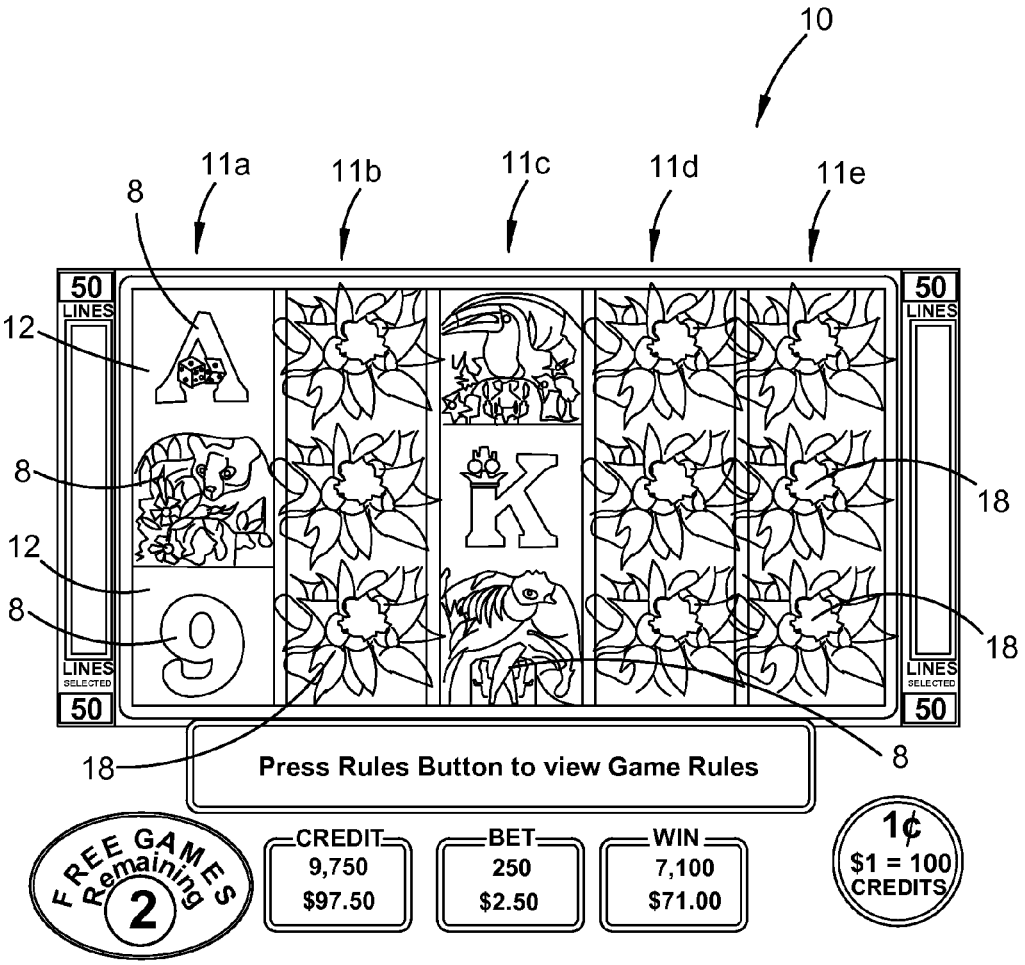

The display 7 is used to display game symbols 8 for playing a base or main game 9 and a feature game 10 on the electronic gaming machine 1, as best shown in FIGS. 3 and 5. A player inserts a monetary amount into the electronic gaming machine 1 and selects an initial bet to initiate play of the base game 9. As best shown in FIG. 3, in the base game 9, the game symbols 8 are arranged in an array of predetermined groups in the form five columns or "reels" 11*a*, 11*b*, 11*c*, 11*d*, 11*e*. The reels 11 are also alongside each other to form three rows and each have three visible positions in the form of cells 12 that each displays a game symbol 8. It will be appreciated by one skilled in the art that other arrays could be used, such as the industry standard 5×3 or 3×3, 4×3, 5×5, 4×4, etc. Also, arrays with uneven rows and/or columns may also be used in other embodiments.

The game symbols 8 typically include picture symbols, wild symbols, scatter symbols and card symbols. Predetermined winning combinations of randomly selected game symbols 8 in the base game 9 result in the award of prizes to the player. These predetermined combinations of game symbols are typically in the form of pay lines that have at least one cell 12 from each reel 11.

The electronic game controller 4 controls the display of the game symbols 8 in the base game 9. In response to a trigger event during play of the base game 9, the electronic game controller 4 causes the feature game 10 to appear on the display 7 for play by the player, as best shown in FIGS. 5 to 8 where corresponding features have been given the same reference numerals. In this embodiment, the feature game 10 comprises game symbols 8 that are also arranged in an array of predetermined groups in the form of five reels 11, each having three cells 12 to display game symbols 8. As in the base game 9, the reels 11 of the feature game are alongside each other to form three rows. The game symbols 8 also typically include picture symbols, wild symbols, scatter symbols and card symbols that are the same as the game symbols in the base game 9.

The feature game 10 comprises a predetermined number of free plays or spins of the reels 11. That is, the reels 11 in the feature game 10 are spun without requiring the player to make a bet, unlike the base game 9. In the feature game 10, predetermined winning combinations of randomly selected game symbols 8 result in the award of prizes to the player. In this embodiment, the predetermined winning combinations of game symbols 8 can award the same prizes available in the base game 9. Similarly, the electronic game controller 4 also controls the display of the game symbols 8 in the feature game 10.

Operation of this embodiment of the invention will now be described in more detail with reference FIGS. 3 to 8, where corresponding features have been given the same reference numerals. The player initially makes a bet using vending slots 5 initiate play of the base game 9 and the electronic game controller 4 causes the reels 11 to appear to visibly rotate or "spin", and randomly display the game symbols 8. The initial bet involves the player selecting the number of pay lines that are to be played. For example, the player can bet or wager 50 credits to play 10 pay lines or 200 credits to play the maximum number of 50 pay lines. Also, the player can make any additional side bets or ante-bets to access additional features in the base game, such as increasing the number of winning combinations in the base game.

Figure 4:
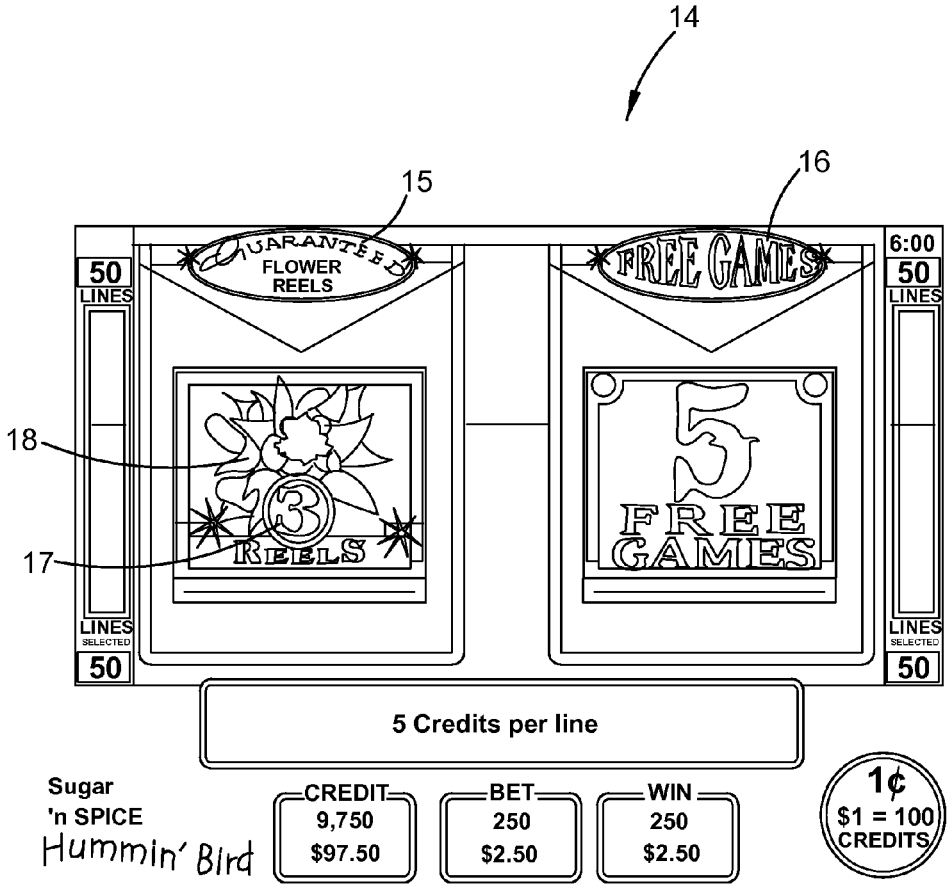

After the reels 11 stop spinning, the controller 4 determines whether there are any predetermined winning combinations of the game symbols 8 appearing in any player-selected pay lines, such as a two of a kind, three of a kind, four of a kind or five of a kind. It will be appreciated that other winning combinations of game symbols 8 can also be provided. If there is a predetermined winning combination present in the base game 9, the electronic gaming machine 1 enters a winning game state and awards a prize according to the displayed predetermined winning combination.

Where a predetermined trigger event occurs during play of the base game 9, which in this embodiment is the appearance of three scatter symbols in the form of a decorative seascape symbols 13 (as best shown in FIG. 3), the electronic game controller 4 causes the display of a transition screen 14, as best shown in FIG. 4.

The trigger event also comprises the electronic game controller 4 randomly generating a number and determining whether that number is a predetermined number or falls within a predetermined range of numbers. The predetermined number or predetermined range of number corresponds to the number of reels 11 that are selected by the electronic game controller 4. For game play reasons the maximum number of reels that are selected will always be one less than the maximum number of available reels. For example, the electronic game controller 4 can generate a number between 1 and 100 and any number between 1 and 25 would mean only one reel 11 is selected, any number between 25 and 50 would mean that two reels are selected, any number between 51 and 75 would mean that three reels are selected and any number between 75 and 100 would mean that four reels are selected. This can be used for any range of randomly generated numbers and the individual ranges corresponding to the number of reels can also be adjusted so that there is a progressively lower probability as the number of selected reels increase. For example, the probability selecting four reels would be less than the probability of selecting one reel.

Alternatively, the electronic game controller 4 can randomly generate a number that is equivalent to the number of reels that are selected. For example, if the number is two, then the electronic game controller 4 selects two reels 11 to each display at least one special symbol in during play of the feature game 10.

The transition screen 14 has two information panels 15 and 16 to display information about the feature game 11 to the player. Information panel 15 indicates to the player the number 17 of reels 11 that are guaranteed to display at least one special symbol in the form of a flower symbol 18. Thus, the selected reels 11 are guaranteed to have at least one flower symbol 18 appear on the display 7 at the end of the spin or play. In this case, the information panel 15 indicates that three of the five reels 11 are guaranteed to have a flower symbol 18. Information panel 16 indicates to the player the number of plays or spins of the feature game 10 that have been awarded to the player. In this case, 5 free spins have been awarded to the player.

After the transition screen 14, the electronic game controller 4 causes the display of the feature game 10 on the display 7, as best shown in FIGS. 5 to 8. The initial conclusion of a spin or play of the feature game 10 is illustrated in FIG. 5, where the electronic game controller 4 has selected reels 11*b*, 11*d* and 11*e* (corresponding to reels 2, 4 and 5 under the conventional numbering of reels) to display the flower symbol 18 according to a predetermined order as set out in table 19, as best shown in FIG. 9 and discussed in more detail below. In this embodiment, the flower symbol 18 occupies each visible position of the selected reels 11*b*, 11*d* and 11*e*. However, it will be appreciated the special symbols 18 do not necessarily appear on each visible position or cell 12 of the selected reels 11*b*, 11*d*, 11*e*, but can appear on any number of positions on each selected reel.

Figure 6:
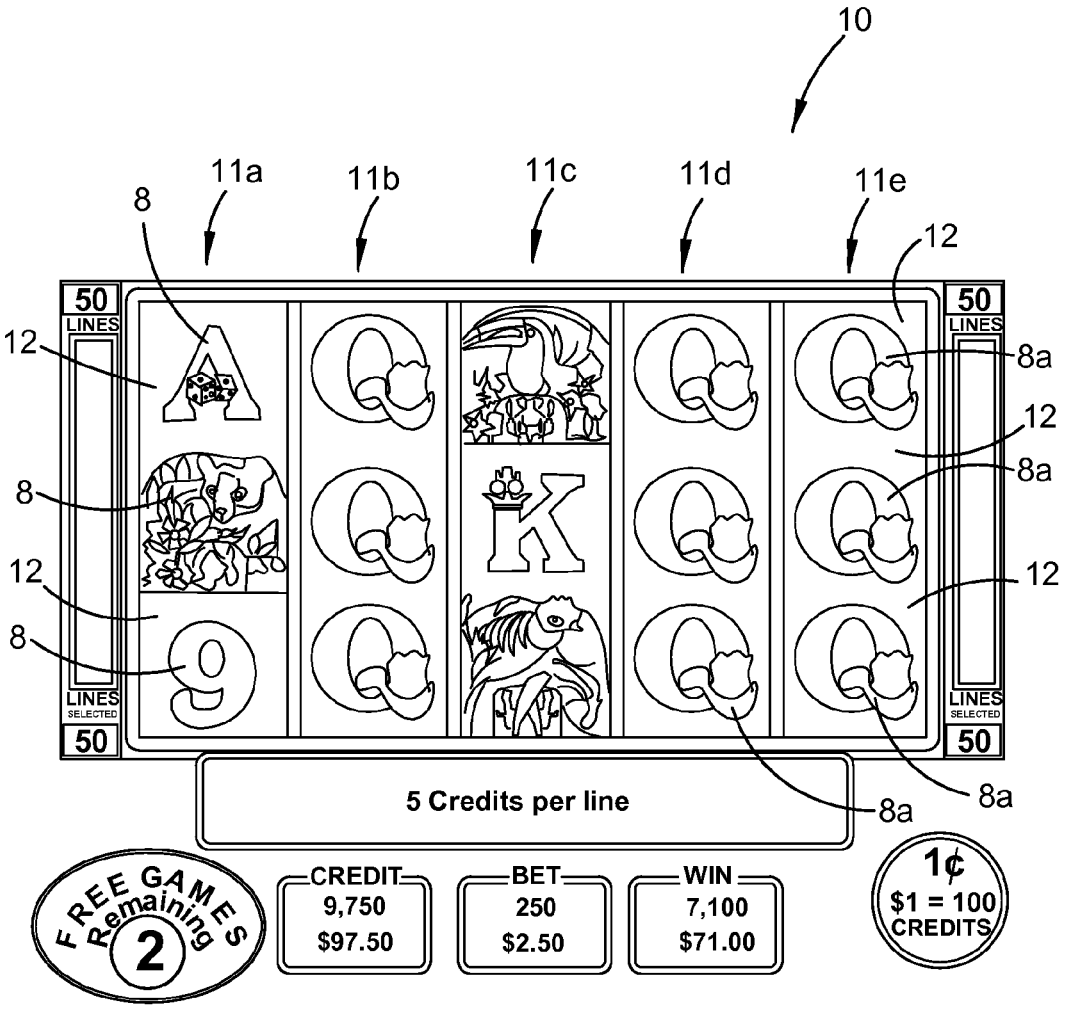

Also, the flower symbol 18 is a replacement symbol, meaning that the flower symbol changes into another game symbol 8 at the conclusion of a spin or play of the feature game 10. The game symbols in this embodiment include playing card symbols 8*a*, picture symbols 8*b*, wild symbols and scatter symbols 13. In this case, the flower symbol 18 has randomly changed to queen card symbols 8*a*, as best shown in FIG. 6. The queen card symbols 8*a* occupy the same cells 12 that were previously occupied by the flower symbols 18. After the conversion or change of the flower symbols 18, the electronic game controller 4 determines whether there are any predetermined winning combinations of game symbols 8 on the display 7. Hence, the increased number of queen card symbols 8*a* increases the chances of the player winning a prize and/or winning a prize of higher value than otherwise would be obtained by a conventional spin of the reels 11 in the feature game 10. Thus, the guarantee of selected reels 11 that will display special symbols increases the player's excitement and enhances his or her interest in playing the electronic gaming machine 1.

Figure 7:
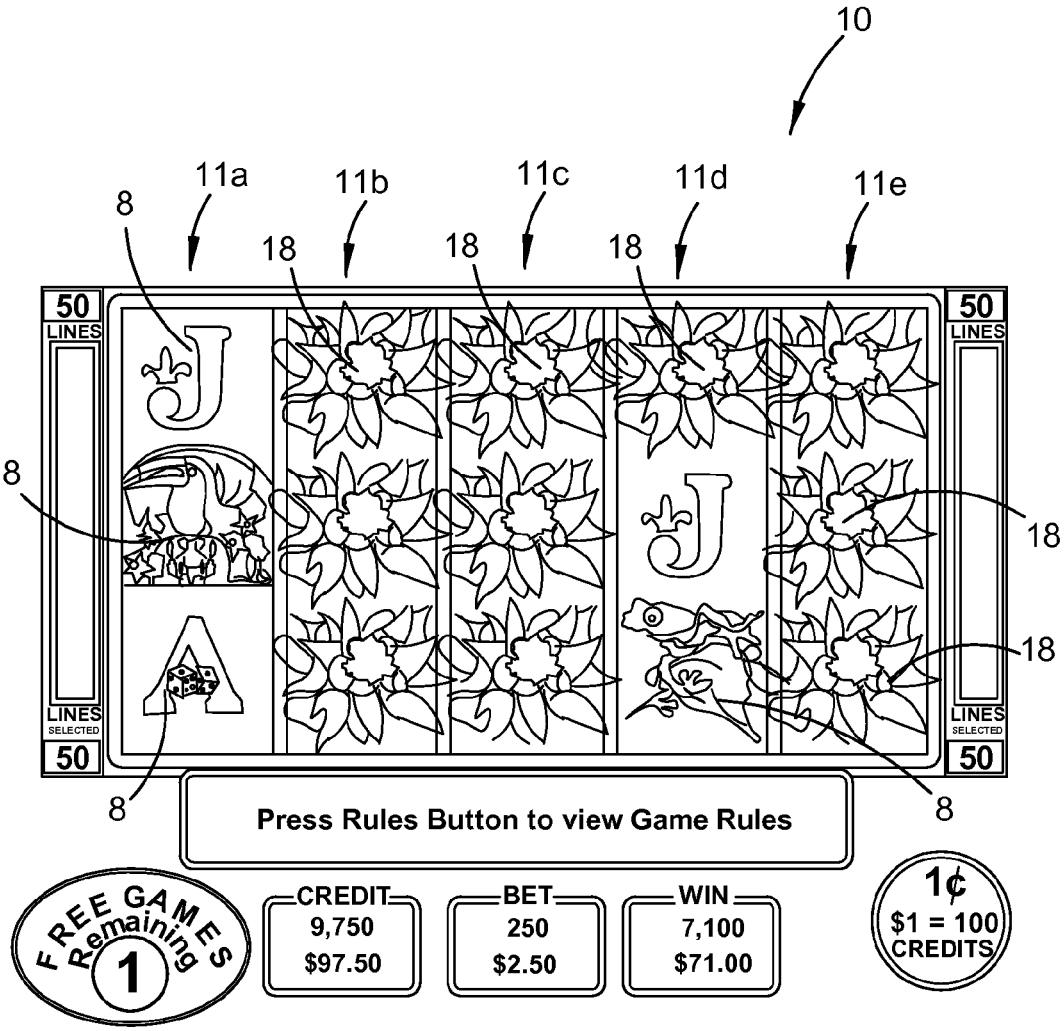
Figure 8:
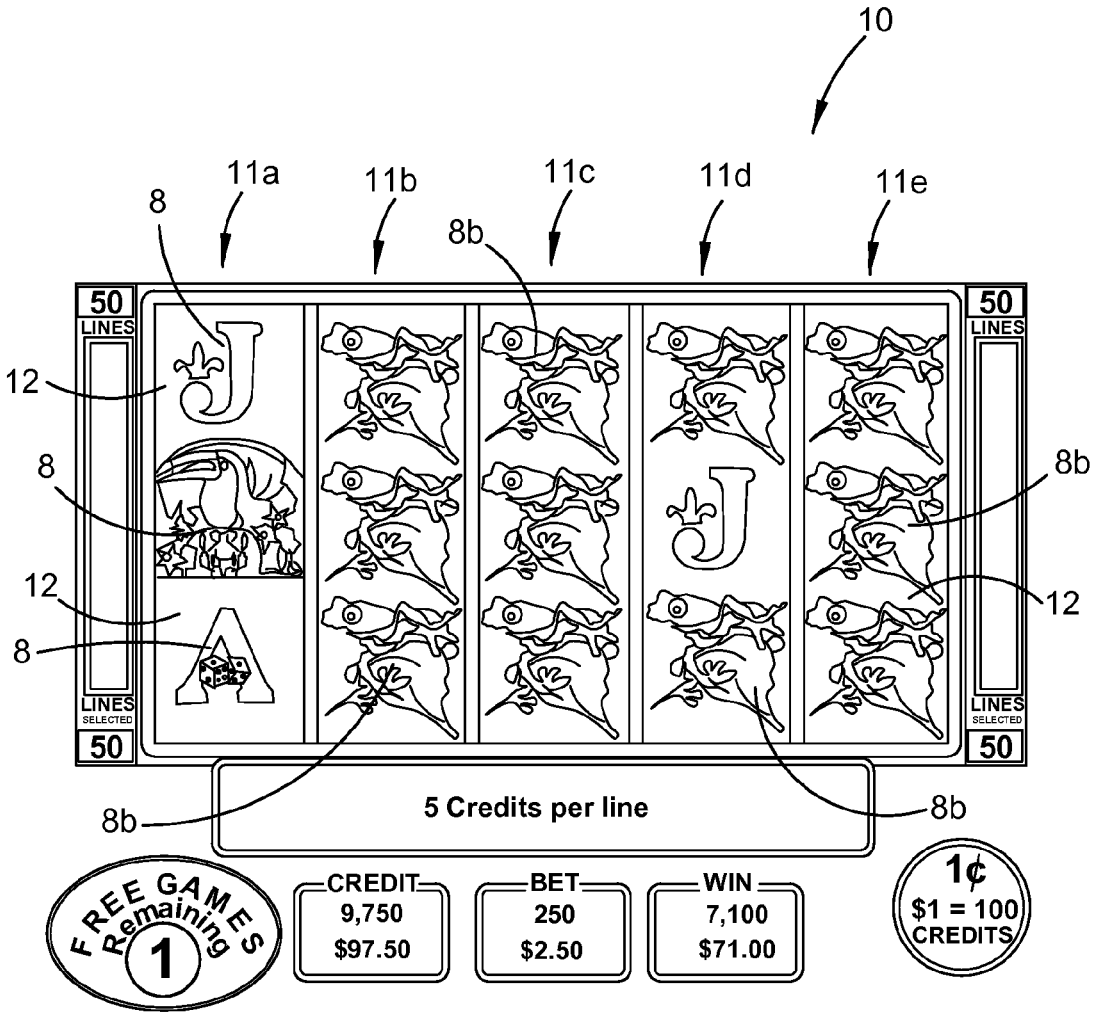

The next play of the feature game 10 is shown in FIG. 7, where corresponding features have been given the same reference numerals. The electronic game controller 4 has selected a different reel, being reel 11*c* (corresponding to reel 3 under the conventional numbering of reels), to the previously selected reels to display the flower symbol 17. The electronic game controller 4 has also reselected two of the previously selected reels 11, being reels 11*b* and 11*e* (corresponding to reels 2 and 5 under the conventional numbering of reels). New reel 11*c* was not selected in the preceding play shown in FIGS. 5 and 6. Again, in this embodiment, the flower symbol 18 appears in each visible position or cell 12 of each selected reel 11*b*, 11*c* and 11*e*.

As with the preceding spin, the flower symbol 18 changes into another game symbol 8, in this case, frog symbol 8*b*. After the replacement of the flower symbols 18, the electronic game controller 4 determines whether there are any predetermined winning combinations of game symbols 8 on the display 7. The increased number of frog symbols 8*b* increases the chances of the player winning a prize and/or winning a prize of higher value than otherwise would be obtained by a conventional spin of the reels 11 in the feature game 10.

It should be noted that the guaranteed appearance of the special symbol 18 on the selected reels 11 do not prevent the appearance of the special symbol on non-selected reels in any of the free spins of the feature game 10. Since the electronic game controller 4 randomly determines the game symbols 8 that appear on the non-selected reels, the special symbol can appear on any non-selected reel. For example, as shown in FIG. 7, a flower symbol 18 is shown in the top position of reel 11*d* even though this reel was not selected by the electronic game controller 4 as guaranteeing the appearance of a flower symbol. This additional flower symbol 18 also changes to the same game symbol, being a frog symbol 8*b*, as the other flower symbols.

In successive spins of the feature game 10, the electronic game controller 4 continues to select a new reel that was not selected in that preceding spin to display the flower symbols 18, as well as reselecting one of the selected reels from the preceding play or spin of the feature game.

Once all the free spins have been played in the feature game 10, the electronic game controller 4 returns the electronic gaming machine 1 to the base game 9. The electronic gaming machine 1 will await the trigger event to occur in a play of the base game 9 before proceeding to the feature game 10.

Referring to FIG. 9, table 19 shows the predetermined order in which the electronic game controller 4 selects the reels 11*a*, 11*b*, 11*c*, 11*d*, 11*e* that are guaranteed to display the special symbol(s) 17 in the feature game 10. In the table 19, column 20 lists the number of free spins that are randomly selected by the electronic game controller 4, while columns 21, 22, 23 and 24 indicate the number of selected reels (1, 2, 3 and 4 reels, respectively) that are randomly determined by the electronic game controller 4. Each cell of the table 19 indicates which of the reels are selected by the electronic game controller 4 based on the criteria in columns 20, 21, 22, 23 and 24. For example, in the embodiment described in FIGS. 5 to 8, the electronic game controller 4 randomly determines that five free spins are given to the player and that three reels are selected or guaranteed. Based on these criteria, cell 25 of table 19 indicates that for the first spin, reels 11*b*, 11*d* and 11*e* (corresponding to reels 2, 4 and 5 under the conventional numbering of reels) are selected to display the flower symbols 18. Cell 26 of table 19 indicates that for the second spin, reels 11*b*, 11*c* and 11*e* (corresponding to reels 2, 3 and 5 under the conventional numbering of reels) are selected to display the flower symbols 18. Cell 27 of table 19 indicates that for the third spin, reels 11*a*, 11*c* and 11*e* (corresponding to reels 1, 3 and 5 under the conventional numbering of reels) are selected to display the flower symbols 18. The fourth spin corresponds to FIGS. 5 and 6, and cell 28 of table 19 indicates that reels 11*b*, 11*d*, 11*e* (corresponding to reels 2, 4 and 5 under the conventional numbering of reels) are selected to display the flower symbols 18. Finally, the fifth spin corresponds to FIGS. 7 and 8, and cell 29 of table 19 indicates that reels 11*b*, 11*c*, 11*e* (corresponding to reels 2, 3 and 5 under the conventional numbering of reels) are selected to display the flower symbol 18.

It should also be noted from table 19 that the electronic game controller 4 may reselect more than one previously selected reel between successive spins of the feature game 10. For example, in column 24 of table 19, reels 3 and 5 are reselected for spins 4 to 7, as indicated by cells 30, 31, 32 and 33.

In one preferred form, the invention is implemented in a base game, rather than a feature game. In this preferred form, the base game would operate as described above in relation to FIGS. 5 to 8, but in this case initial and subsequent plays where the reels are selected, and reselected with a newly selected reel, integrate into the play of the base game 9.

In another preferred form, the plays or spins need not be free as described in the preferred embodiment. Rather, the player may be required to make a further bet in order to play the spins in which the reels are selected and reselected with a new reel. Alternatively, where the invention is implemented in a base game 9, the player makes a bet for each spin as in a conventional base game.

In a further preferred form, the groups take the form of single cell reels, each arranged into an array. In this further preferred form, the single cell reels spin independently of each other, even though they may the organised into an array having rows and columns. For example, three single cell reels may the organised to form a single column in an array. Likewise, fifteen single cell reels can be used to fill a standard 5×3 array, with five single cell reels in each column. Also, the groups may be multi-cell reels having cells less than or greater than the five-cell format found in standard reels.

The preferred embodiment has been described as reselecting at least one previously selected reel from the preceding spin and selecting a new reel that was not selected in the preceding spin for each successive spin in the feature game 10. However, it will be appreciated that not each successive spin has to reselect one of the selected reels from the preceding spin, and instead the electronic game controller 4 can reselect at least one of the selected reels from a preceding play of said game and select a new column that was not selected in that preceding play for only a predetermined number of successive plays. For example, in another preferred embodiment, the electronic game controller 4 may reselect at least one selected reel and select a new reel for 5 successive free spins where 10 free spins have been awarded in the feature game. Also, the first spin and its subsequent spin in the feature game need not be consecutive, but instead the subsequent spin may occur later in the sequence of free spins. Furthermore, the "first" or initial spin in which the reels are selected to guarantee display of the special symbol (s) need not be the first spin of the feature game, but may occur as a later spin in the sequence of free spins in the feature game. For example, the initial or "first" spin illustrated in FIGS. 5 and 6 can be a spin following the first play or spin of the feature game, such as the second or sixth spin in a sequence of 10 spins.

While the same game format is essentially used across the base game 9 and feature game 10, it will be appreciated that the game format may vary across both games. For example, the base game 9 may be a wheel-type game or a four reel game and the feature game 10 may be standard five reel game. Similarly, the base game 9 and feature game 10 may each have different game symbols, game rules and pay tables that are unique to each game.

Also, in another preferred form, there is no need for a trigger event in the form of the appearance of a predetermined number of trigger symbols. Instead, the electronic game controller 4 can internally determine when to select reels that guarantee the appearance of special symbol(s). One way to implement this preferred form is for the electronic game controller 4 to internally generate a random number and checks if it is a predetermined number or within a predetermined range of numbers that will initiate selection of reels that guarantee the appearance of special symbol(s). For example, the predetermined range of numbers could be the range of numbers between 1 and 10 and the electronic game controller 4 internally generates a random number between 1 and 100. If the generated number is any one of numbers 1 to 10, then this results in the electronic game controller 4 displaying the feature game 10 with a suitable message to the player, such as the transition screen 13, and then determines the number of reels 11 that are selected to show the special symbol 18. Thus, the internal random number generation initiates both the feature game 10 and the number of reels 11 that are selected to show the special symbol 18. Alternatively, the electronic game controller may perform two separate internal random number generations to determine initiation of the feature game 10 and the number of reels selected to display the special symbol 18.

Other forms of special symbols 18, beside replacement symbols, can include one or more of bonus prizes, collector symbols, a win multiplier, wild multipliers, bonus wilds, random wild symbols, progressives, bonus credits and jackpot symbols. Progressives operate in a similar manner to jackpot symbols in that a prize is awarded upon a certain number of progressive symbols are accumulated by the player over a number of games played on the gaming machine. It will be appreciated that the special symbol 18 is not limited to these game symbols and can include other game symbols.

While the embodiment of the invention has been described in relation to a base game and a feature game, it will be appreciated that the invention could include an additional feature game that is triggered by specific trigger symbols appearing in the feature game 10. Also, the additional feature game may also have trigger symbols that trigger further feature game in a cascading fashion. These additional and further feature games could have the same game play elements as the feature game 10 or be different feature games entirely.

Also, in a further preferred form, the player can selectively stop spinning of the reels 11 in the feature game 10 to increase player interaction. Furthermore, the player can start spinning of the reels 11 in the feature game 10 to further enhance player interaction.

In other preferred forms, the base game 9 and feature game 10 are displayed on separate screens, rather than being sequentially replaced on a single screen 7. Alternatively, the base game 9 and feature game 10 are displayed together on the screen 7, with suitable animation or highlighting being used to indicate that the feature game 10 has become active.

In another preferred form, the video screen 7 is a touch screen for use in addition to the player-actuatable buttons 6 so as to enable the player to select various features, such as making monetary bets for the game and responding to any messages or requests issued on the electronic gaming machine 1 by the electronic game controller 4. In this case, the player may control when the reels 11 start spinning and stop spinning in any of the base game 9 and feature game 10 by simply touching the relevant reel 11.

It will be appreciated that while the preferred embodiments have been described in relation to an industry standard electronic gaming machine, the invention can be readily applied to other types of electronic gaming machines, including a personal computer (standing alone or connected to a communications network, LAN or WAN), mobile electronic devices (such as handheld or portable electronic devices) and other electronic devices capable of displaying a game. In the case of mobile electronic device, in one arrangement it may permit the player to make bets using "virtual" credits that represent a monetary value, but do not require the player to make a monetary transaction. Instead, the invention may provide a tiered access to the various features of the game so that the player can make relatively small payments to access particular features of the game or obtain additional benefits during game play. An alternative arrangement would require the player to purchase virtual credits or tokens via an interface on the mobile electronic device or an online interface accessible by the mobile electronic device. Similarly, either of the above described arrangements can be applied where the invention is implemented on a personal computer (PC) connected to the internet (wirelessly or not). In one example of the implementation, the PC would access an online casino over the internet to play the game of the invention or the game of the invention would be part of a social networking website. It is also contemplated that the player could also make regular payments to subscribe to continue playing the game on the mobile electronic device, PC or other electronic device.

In an alternative embodiment, the electronic gaming machine also provides an option for the player to play with either credits based on a monetary amount or virtual credits as discussed above. This can be implemented by way of a selection menu prior to playing the selected game or by providing a suitable menu button on screen during play of the selected game.

In another aspect, the invention includes a computer program configured to perform the invention. In this way the invention can be implemented in various ways on an electronic gaming machine. In a further aspect, the invention includes a computer system configured comprising a central processing unit configured for communication with an electronic gaming machine to perform the invention. In a yet another aspect, the invention includes a non-transitive carrier medium carrying computer executable code that, when executed on a central processing unit configured for communication with an electronic gaming machine, causes said central processing unit to perform the invention. In this case, the non-transitive carrier medium includes an external hard drive, a memory device, including a memory card, smart card, a radio frequency identification (RFID) device, USB key, magnetic card or other electronic storage device.

It will further be appreciated that any of the features in the preferred embodiments of the invention can be combined together and are not necessarily applied in isolation from each other. For example, the feature of providing a limited number of successive spins where reels are selected and reselected with a new reel in a larger set of free spins can be readily combined with the feature of including trigger symbols in the feature game to trigger additional feature games.

By making at least one reel guarantee the appearance of special symbols, with at least one of the guaranteed reel(s) changing between spins of the game, the invention increases player excitement and interest in the game, thus encouraging the player to continue playing the same electronic gaming machine. Furthermore, the reselection of a previously selected reel and selection of a new reel also enhances the player's anticipation between plays or spins of the feature game, as the player knows that a new reel will show special symbol(s) in addition to at least one previously selected reel. The invention thus provides a combination of predictable elements (the guarantee of special symbols on at least one reselected reel and a new reel) and unpredictable elements (which of the reels are reselected and newly selected) to provide a variety in game play not seen in convention electronic gaming machines. All these advantages of the invention result in the player being more likely to retain interest in continuing to play the same electronic gaming machine. Furthermore, since the electronic game controller controls operation of the base game and feature game, the invention can be readily implemented to existing gaming machines and other gaming systems. In all these respects, the invention represents a practical and commercially significant improvement over the prior art.

Although the invention has been described with reference to specific examples, it will be appreciated by those skilled in the art that the invention may be embodied in many other forms.

The invention claimed is:

1. An electronic gaming machine comprising:

a memory device adapted to store a plurality of instructions for playing a game and a plurality of game symbols for use in the game, the plurality of game symbols including a special symbol and a plurality of game symbol types, wherein the game symbol types includes picture symbols, wild symbols, and card symbols;

a display adapted to display game symbols for playing a game, where predetermined winning combinations of randomly selected game symbols award prizes to a player and the plurality of game symbols are arranged in an array of predetermined groups such that one of the game symbols is displayed in each one of a plurality of visible symbol positions of each predetermined group;

vending slots to receive physical monetary amounts inserted into the vending slots by a player; and an electronic game controller being adapted to execute the plurality of instructions:

determine if an initial bet has been received using the vending slots to initiate play of the game, control the random selection and display of the plurality of the game symbols in the game on the display if the initial bet has been received, determine whether any predetermined winning combinations of game symbols are displayed in the game, if one of the predetermined winning combinations of game symbols is displayed, award one of the prizes to the player for the game, determine if a trigger event occurs, and when the trigger event occurs, present a first bonus play of the game and a second, subsequent bonus play of the game wherein each bonus play guarantees that at least two of the predetermined groups display the special symbol;

wherein in the first bonus play, the electronic game controller executes the plurality of instructions to:

select two or more first groups from the array of predetermined groups to each display the special symbol, for each first group, display the special symbol in at least one visible symbol position, wherein the special symbol displayed in the at least one visible symbol position of a first one of the two or more first groups is identical to the special symbol displayed in the at least one visible symbol position of the others of the two or more first groups, change each special symbol into a first game symbol type of the plurality of game symbol types so that each special symbol displayed in each of the first groups is replaced with the first game symbol type, wherein each of the first game symbol type is different from the special symbol and wherein each of the first game symbol type is identical to one another in each first group, determine whether the plurality of game symbols displayed in the first bonus play of the game cause any of the predetermined winning combinations to be displayed in the first bonus play of the game, and determine whether one of the predetermined winning combinations is displayed, award one of the prizes to the player for the first bonus play of the game, and wherein in the second, subsequent bonus play, the electronic game controller executes the plurality of instructions to:

select two or more second groups from the array of predetermined groups to each display the special symbol, wherein at least one second group is different from the at least one of the two or more first groups of the array of predetermined groups, for each second group, display the special symbol in at least one visible symbol position, wherein the special symbol displayed in the at least one visible symbol position of a first one of the two or more second groups is identical to special symbol displayed in the at least one visible symbol position of the others of the two or more second groups, change each special symbol into a second game symbol type of the plurality of game symbol types so that each special symbol displayed in each of the second groups is replaced with the second game symbol type, wherein each of the second game symbol type is different from the special symbol and wherein each of the second game symbol type is identical to one another in each second group, determine whether the plurality of game symbols displayed in the subsequent bonus play of the game cause any of the predetermined winning combinations to be displayed in the second, subsequent bonus play of the game, and determine whether one of the predetermined winning combinations is displayed, award one of the prizes to the player for the second, subsequent bonus play of the game.

2. The electronic gaming machine of claim 1, wherein in the subsequent bonus play, the electronic game controller reselects at least one of the two or more first groups as at least one of the two or more second groups.

3. The electronic gaming machine of claim 2, wherein the electronic game controller selects the two or more first groups, reselects the at least one of the two or more first groups and selects the second groups other than the at least one of the two or more second groups according to a predetermined order for the first bonus play and the second, subsequent bonus play.

4. The electronic gaming machine of claim 2, wherein the electronic game controller randomly selects the two or more first groups, randomly reselects the at least one of the two or more first groups, and randomly selects the second groups other than the at least one of the two or more second groups.

5. The electronic gaming machine of claim 1, wherein the electronic game controller selects the two or more first groups in the first bonus play and the two or more second groups in the second, subsequent bonus play according to a predetermined order.

6. The electronic gaming machine of claim 1, wherein the electronic game controller randomly selects the two or more first groups in the first bonus play and the two or more second groups in the second, subsequent bonus play.

7. The electronic gaming machine of claim 1, wherein the electronic game controller randomly generates a number and determines whether the randomly generated number is a predetermined number or within a predetermined range of numbers, the predetermined number or range of numbers corresponding to the number of the first groups selected for the first bonus play.

8. The electronic gaming machine of claim 1, wherein the first and the second, subsequent bonus plays of the game are consecutive.

9. The electronic gaming machine of claim 1, wherein the trigger event comprises the appearance of at least one trigger symbol.

10. The electronic gaming machine of claim 1, wherein the electronic game controller reselects at least one of the selected groups from a preceding play of the game and selects a new group that was not selected in the preceding play for a predetermined number of successive plays of the game after the subsequent play.

11. The electronic gaming machine of claim 1, wherein the electronic game controller reselects at least one of the selected groups from a preceding play of the game and further selects a new group that was not selected in the preceding play for each successive play of the game after the subsequent play.

12. The electronic gaming machine of claim 1, wherein the first and the second, subsequent bonus plays are within a predetermined set of plays of the game.

* * * * *